US005596157A

United States Patent [19]

Williams

[11] Patent Number: 5,596,157

[45] Date of Patent: Jan. 21, 1997

[54] STRINGED MUSICAL INSTRUMENT WITH KEYBOARD

[76] Inventor: Maschon Williams, 4522 Van Ness, Los Angeles, Calif. 90062

[21] Appl. No.: 305,600

[22] Filed: Dec. 12, 1994

[51] Int. Cl.[6] ..... G10D 3/00; G10D 1/08; G10C 3/12

[52] U.S. Cl. ..... 84/170; 84/291; 84/267; 84/423 R

[58] Field of Search ..... 84/170, 171, 172, 84/267, 291, 423 R, 293; D17/14, 2, 1

[56] References Cited

U.S. PATENT DOCUMENTS 522,048 6/1894 Duvivier ..... 84/170

1,425,032 8/1922 Milito ..... 84/170

*Primary Examiner*—Cassandra C. Spyrou

[57] ABSTRACT

A stringed musical instrument is disclosed as including a body with an extending portion on to which a piano-type keyboard is attached. The combination provides the user with the ready access to both the stringed instrument and the keyboard. The user may utilize the stringed instrument and keyboard separately alternating therebetween or simultaneously having one hand of the user play the keyboard as well striking and/or strumming the strings.

1 Claim, 2 Drawing Sheets

STRINGED MUSICAL INSTRUMENT WITH KEYBOARD

The invention is directed to providing a musical device such as a guitar, bass guitar or other similar stringed instrument with a conventional piano-type keyboard that can be played simultaneously with the stringed instrument.

DETAILED DESCRIPTION OF THE INVENTION

Figure 1:
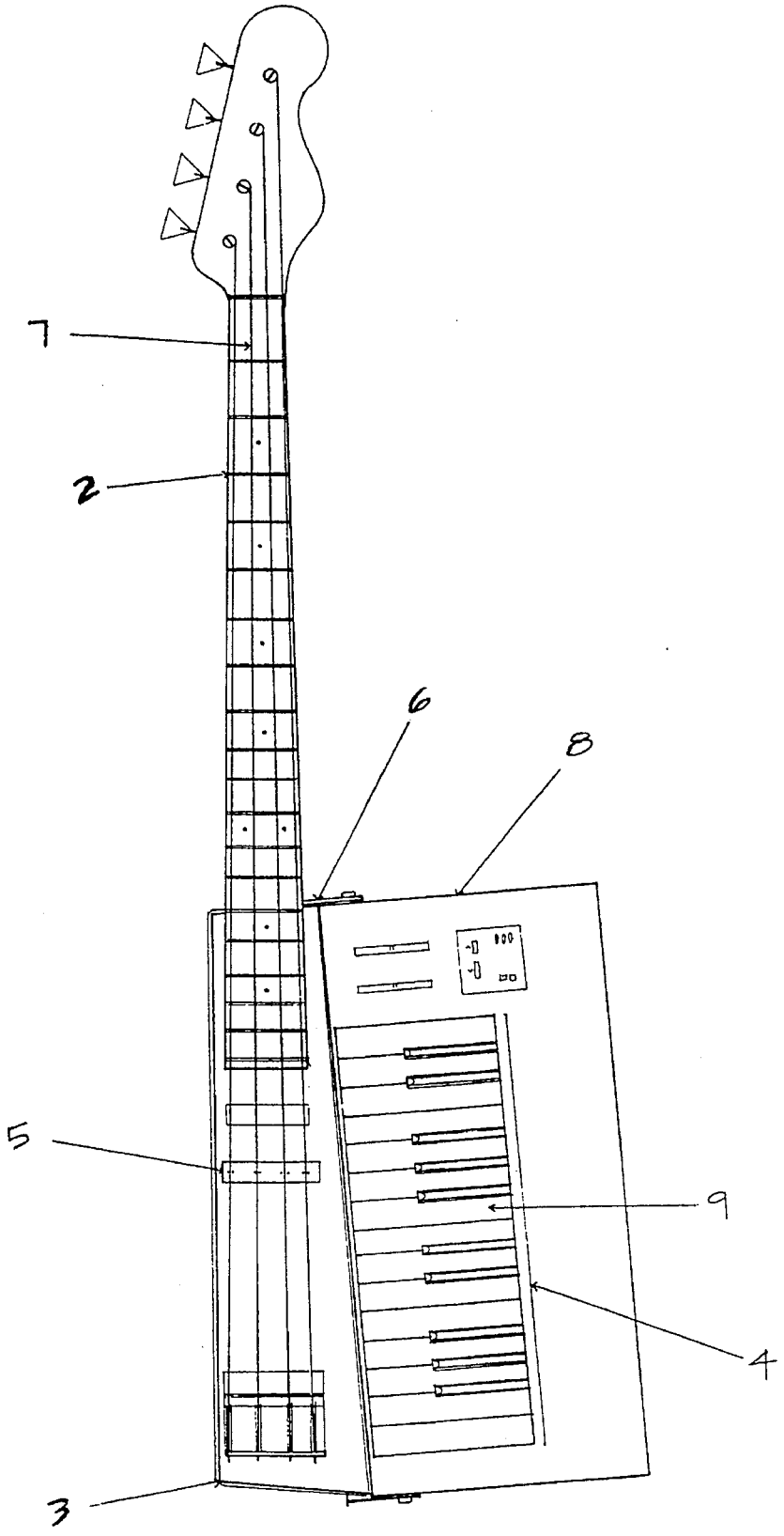
FIG. 1 illustrates a direct view of the stringed instrument with keyboard.
Figure 2:
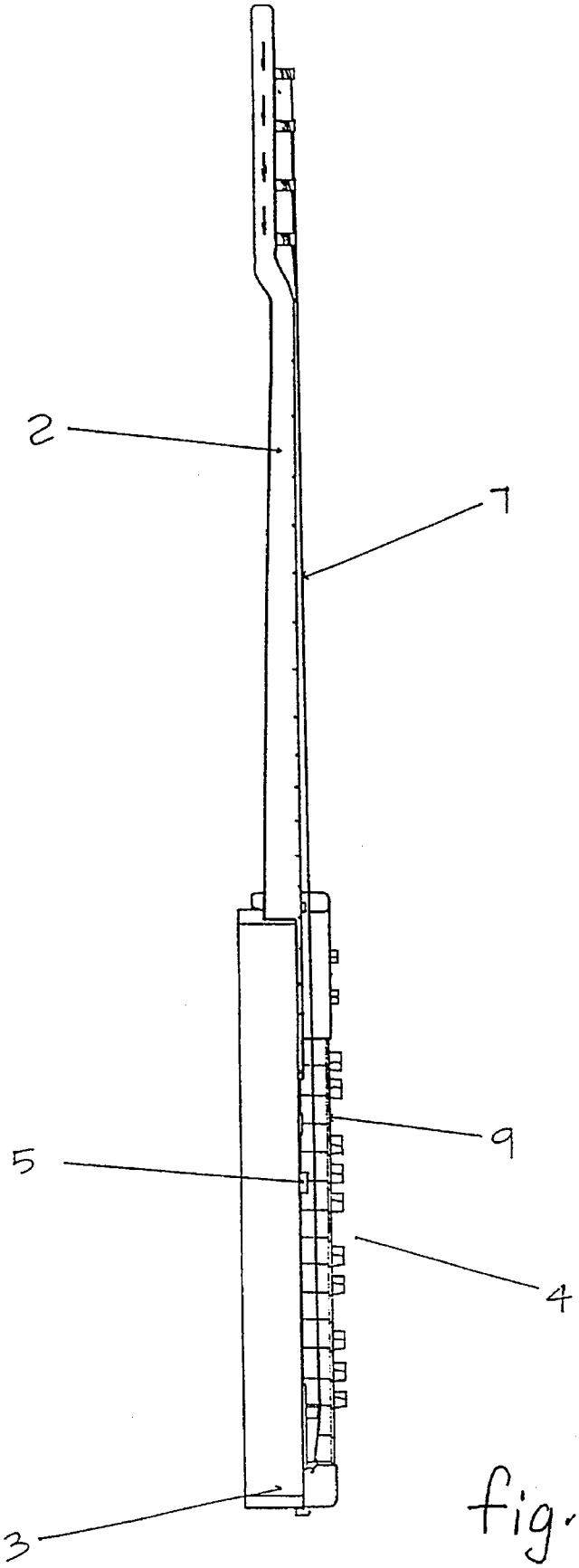
FIG. 2 illustrates the stringed instrument as viewed by a user.

Referring to the drawings, a stringed musical instrument (6) as illustrated has a solid body (3) and a neck (2) attached thereto and extending therefrom. Attached to the body (3) of the instrument are electric pick-ups. The instrument has strings (7) extending and secured across the neck and body (3). The body includes a portion (8) extending outward away from the strings (7). A keyboard is attached to the extending portion (8) on an upper surface thereof. The keyboard has plurality of keys (9).

In operation, a user (1) has ready access to both the stringed instrument (6) and the keyboard (4). The user (1) may utilize the stringed instrument (6) and keyboard (4) separately alternating therebetween or simultaneously having one hand of the user (1) play the keyboard (4) as well striking and/or strumming the strings (7).

What I claim is:

1. A stringed musical instrument comprising:

a solid body;

a neck extending from the body;

a plurality of strings extending across the neck and body;

said body including a portion extending outward from said strings;

a keyboard comprising a plurality of keys;

said keyboard attached to an upper surface of said extending portion.

* * * * *